US007273098B2

(12) United States Patent
Evans et al.

(10) Patent No.: US 7,273,098 B2
(45) Date of Patent: Sep. 25, 2007

(54) METHOD FOR CONTROLLING OIL AND GAS WELL PRODUCTION FROM MULTIPLE WELLS

(75) Inventors: Rick Evans, Houston, TX (US); Michael A. Oehlert, Bryan, TX (US); Trevor Pugh, Tomball, TX (US)

(73) Assignee: Scientific Microsystems, Inc., Waller, TX (US)

( * ) Notice: Subject to any disclaimer, the term of this patent is extended or adjusted under 35 U.S.C. 154(b) by 329 days.

(21) Appl. No.: 11/059,761

(22) Filed: Feb. 17, 2005

(65) Prior Publication Data

US 2005/0178545 A1 Aug. 18, 2005

Related U.S. Application Data

(60) Provisional application No. 60/545,076, filed on Feb. 17, 2004.

(51) Int. Cl.
*E21B 43/12* (2006.01)
*G05D 7/00* (2006.01)

(52) U.S. Cl. ..... 166/250.15; 166/369; 166/53; 137/112; 700/282

(58) Field of Classification Search ..... 166/369, 166/53, 66, 372, 250.15; 137/112, 113; 702/2, 702/6, 12, 14, 45, 47, 50, 98, 100, 104, 138; 700/282, 301
See application file for complete search history.

(56) References Cited

U.S. PATENT DOCUMENTS 2,845,125 A * 7/1958 Truman ..... 166/52
4,526,228 A 7/1985 Wynn ..... 166/53
4,633,954 A 1/1987 Dixon et al. ..... 166/372
4,664,602 A 5/1987 Gordon ..... 417/56
4,685,522 A 8/1987 Dixon et al. ..... 166/372
4,921,048 A 5/1990 Crow et al. ..... 166/372
5,427,504 A 6/1995 Dinning et al. ..... 417/59
6,158,508 A * 12/2000 Lemetayer et al. .... 166/250.15
6,454,002 B1 * 9/2002 Stokes et al. ..... 166/250.15
6,595,287 B2 * 7/2003 Fisher ..... 166/250.15
6,634,426 B2 10/2003 McCoy et al. ..... 166/254.1
6,883,606 B2 * 4/2005 Evans et al. ..... 166/250.15
7,152,681 B2 * 12/2006 Olsen et al. ..... 166/357
2003/0145986 A1 8/2003 Evans et al. ..... 166/250.15

* cited by examiner

*Primary Examiner*—David Bagnell
*Assistant Examiner*—Robert Fuller
(74) *Attorney, Agent, or Firm*—Tim Headley

(57) ABSTRACT

A method for producing oil or gas from multiple wells, the wells including at least a first well and a second well, with each well using an artificial lift system that includes a plunger associated with a motor valve off time, and first and second identical connecting subsystems that connect their respective wells to a common sales line. The first connecting subsystem includes: a) a plunger arrival sensor connected to a micro controller; b) a wellhead connected to the first well; c) a motor valve connected to the wellhead; d) first and second pressure transducers on either side of the motor valve, conductively coupled to the micro controller; and e) a micro controller for keeping the motor valve closed during the motor valve off time, and extending the motor valve off time following a determination of the existence of a pressure spike in the common sales line.

14 Claims, 4 Drawing Sheets

METHOD FOR CONTROLLING OIL AND GAS WELL PRODUCTION FROM MULTIPLE WELLS

CROSS-REFERENCES TO RELATED APPLICATIONS

This application claims the benefit of the following U.S. Provisional Application No. 60/545,076, filed Feb. 17, 2004.

STATEMENT REGARDING FEDERALLY SPONSORED RESEARCH OR DEVELOPMENT

Not applicable.

REFERENCE TO A "SEQUENTIAL LISTING."

Not applicable.

BACKGROUND OF THE INVENTION

1. Field of the Invention

The present invention relates to control of oil or gas well production in the latter stages of well life and, more particularly, to a device and method for controlling the action of a cluster of oil and or gas wells that are sharing a production line or sales line while using a plunger lift system or an oil lift system; generally, any artificial lift system.

2. Description of the Related Art

In many oil and gas well fields with artificial lift system production installations the well flow lines or sales lines are connected through a common manifold. Flow lines, sales lines and the common manifold are all interconnected and are collectively known as the sales line. Each well head is separated by a valve; commonly know as the motor valve. They also typically share a sales meter, fluid storage tanks, and separator. This arrangement is known as a well battery. At present in order to produce from these wells, controllers have been developed to synchronize the well flow and cycle timing. These systems turn on each well in sequence, allowing them to flow for a set period of time and then disabling them until all other wells in the well battery have run in order. There is no communication or connection between each well in the system, rather the synchronization depends on accurate clocks in each controller. There are at least two reasons for this cautious approach. First, not all wells in the well battery produce with the same formation pressure. It is therefore possible for stronger wells (wells with higher formation pressure) to completely stop production from other wells attached to the common manifold. The effect of this can be disastrous as the wells will load up with fluid and fail to produce until the fluid has been removed by swabbing. Second, the flow meter can be overrun with more than one well flowing, and the pressure at the separator can be too high.

The present state of the art for electromechanical control systems in the oil and gas recovery industry can be seen in U.S. Pat. No. 5,427,504 (plunger only), U.S. Pat. Nos. 4,921,048, 4,685,522, 4,664,602, 4,633,954 and 4,526,228. Also U.S. Pat. No. 6,634,426 describes the determination of plunger location and well performance parameters in a borehole plunger lift system. The following two patents describe using a single micro controller connected to all wells in a well battery, and using timing to control when motor valves open; U.S. Pat. No. 4,685,522, entitled "Well production controller system", and U.S. Pat. No. 4,921,048, entitled "Well production optimizing system". These patents do not describe a system like the present invention that uses pressure spike detection in a sales line, to control when a motor valve opens. All of these patents are incorporated herein by this reference.

The synchronization method is an inefficient way of producing oil and gas from these wells, because, there are large periods of time when no oil and or gas is flowing to the common manifold. Also the stronger wells are not allowed to produce to their full capacity. Furthermore, the system described in U.S. Pat. No. 4,685,522 has the disadvantage of requiring sensor and power cables from each wellhead to a central controller. These cables sometimes extend to distances of over 700 yards, and usually must be buried in the ground.

Further, the synchronization method does not allow for changes in well and sales line conditions. This invention provides a solution to these problems.

BRIEF SUMMARY OF THE INVENTION

The present invention is a system and method for allowing the individual wells in a well battery, using artificial lift system equipment, to produce when they are ready to produce, and when no other well is producing, thus attempting to guarantee that all wells unload their fluid.

In the preferred embodiment a differential pressure controller, also known generally as a micro controller, is used to measure the differential pressure from the manifold or sales line across the motor valve to the wellhead. The differential pressure controller will not open the motor valve until the motor valve off time period has passed. In this embodiment the differential controller creates an average or instantaneous line pressure reading. The differential pressure controller periodically measures the common sales line pressure and uses the average of the common sales line pressure plus a user-entered common sales line dead band pressure to calculate a common sales line pressure level set point which in turn is used to determine if a common sales line pressure spike has occurred. The differential pressure controller then starts a spike delay period. The differential pressure controller cannot open the motor valve while the spike delay period is running.

In an alternate embodiment a micro controller periodically monitors a pressure switch which is attached to the common sales line. The user sets the pressure switch to a desired pressure at which the switch will trip, and enters a filter time into the micro controller to allow the micro controller time to verify that the pressure switch has truly detected a pressure spike. Once the pressure switch trips, and stays tripped during the filter time, the controller starts the spike delay period, which will delay any attempt to open the motor valve as a result of the pressure switch being tripped.

Other features and advantages of the invention are apparent from the following detailed description of the invention.

DETAILED DESCRIPTION OF THE INVENTION

In the preferred embodiment, the micro controller is a differential pressure controller such as the one presented in pending patent application Ser. No. 10/298,499, published application number U.S. 2003-0145986 A1, and uses two pressure transducers, a plunger arrival sensor, a plunger and a motor valve to control the well production rate and timing.

Figure 1A:
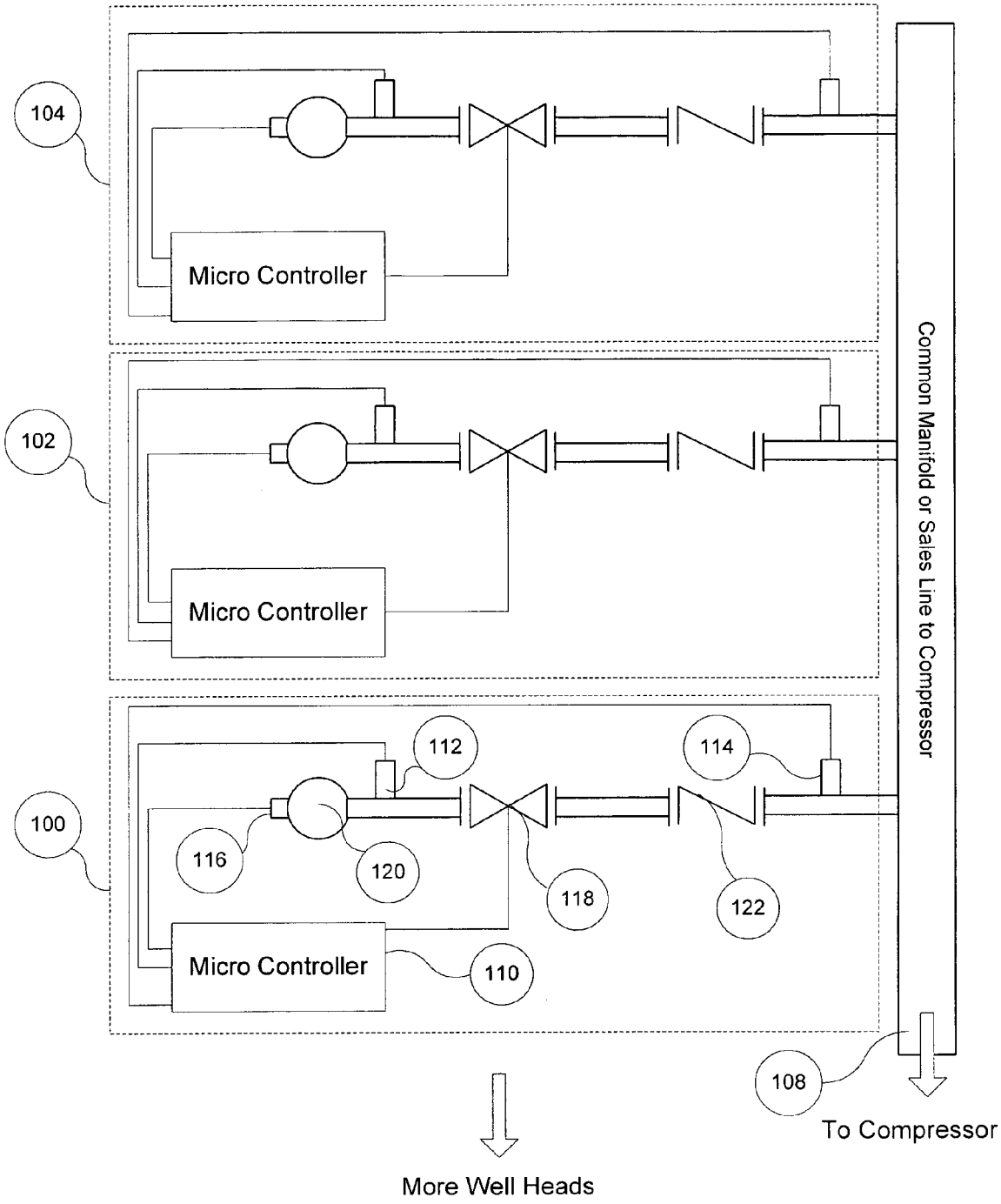
FIG. 1A is a diagram of one embodiment for automatically controlling the production from each of the wells in a well battery, using two pressure transducers in each system.

Referring now to FIG. 1A, a system according to the present invention comprises three identical connecting subsystems 100, 102, and 104 that connect three wells to a common sales line 108. The system is not limited to servicing three wells. Rather, the system can handle two or more wells that are attached to a common sales line 108.

The subsystem 100 includes a micro controller 110, two pressure transducers 112 and 114, a plunger detector 116, a motor valve 118, a well head 120, a check valve 122 and additional equipment associated with any product recovery operation that uses a plunger lift system.

The micro controller 110 is a differential pressure controller, model 006-001-00336, manufactured by US Plunger, located in Tomball, Tex., but could also be a controller, model PCS 3000, manufactured by PCS, located in Fort Lupton, Colo., or any comparable controller. Each of these controllers requires the spike delay period that is tripped by detection of a pressure level, pressure signature, or pressure spike as described below.

The motor valve 118 is a 2200 series motor valve manufactured by Kimray, located in Oklahoma City Okla. but could also be a model 7500 motor valve manufactured by Mallard Control, located in Beaumont, Tex., or any comparable motor valve.

The line pressure transducer 112 and the tubing pressure transducer 114 are both model MSI MSP-400-01K, 200 series pressure transducer, manufactured by Measurement Specialists Inc, located in Newark N.J.

The plunger detector 116 is model number PS-4, manufactured by Tech Tool International, located in Baker, Tex., but could also be an Adjustable Arrival Sensor, manufactured by US Plunger, located in Tomball Tex.

Figure 1B:
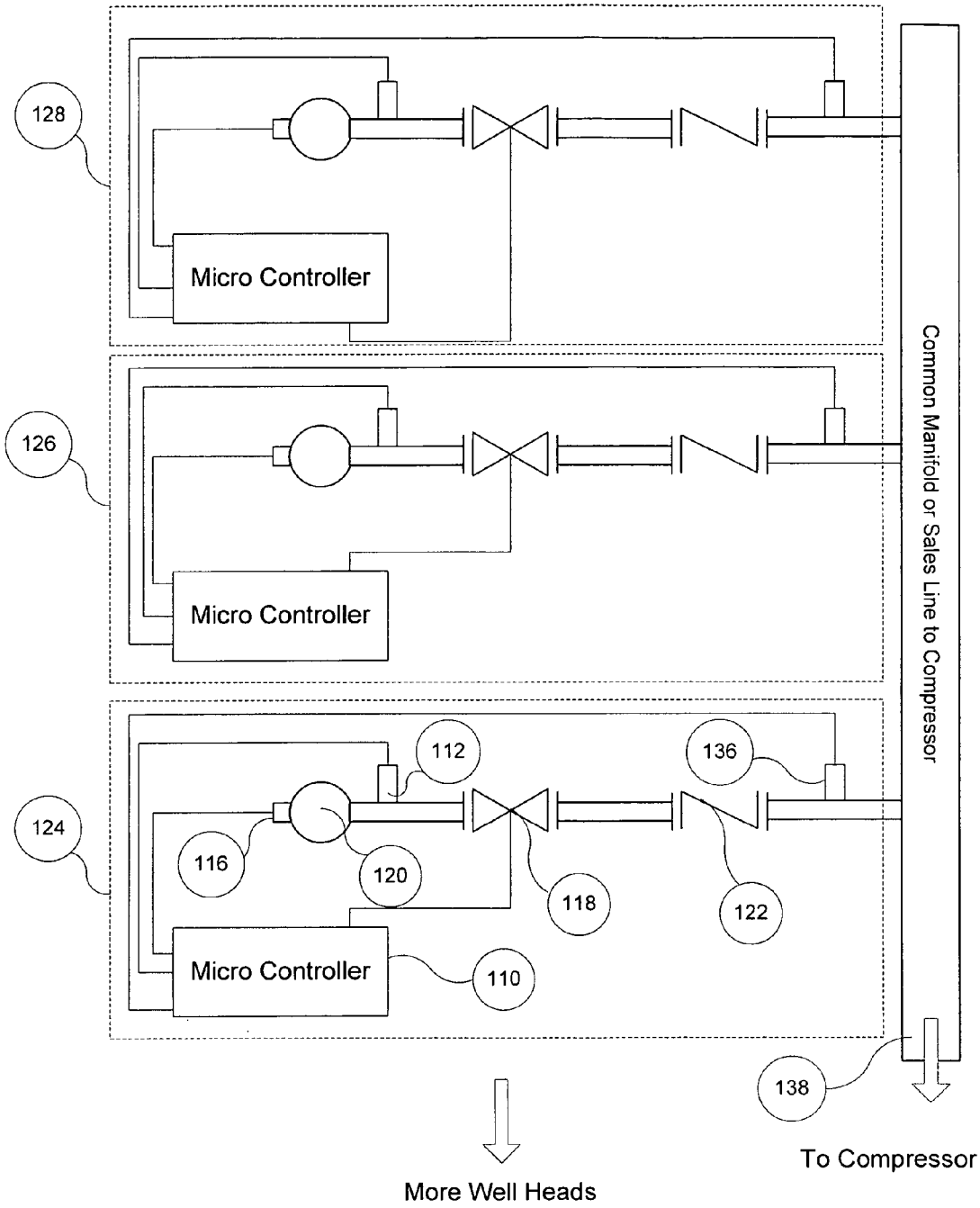
FIG. 1B is a diagram of an alternate embodiment for automatically controlling the production from each of the wells in a well battery, using one pressure transducer and a pressure switch in each system.

Referring now to FIG. 1B, an alternate embodiment of the invention is a system that includes three identical subsystems 124, 126, and 128, that connect three wells to a common sales line 138. The subsystem 124 includes the same elements as the subsystem 100, except that a pressure switch 136 is substituted for the pressure transducer 114.

The pressure switch 132 is the PRESSURE PILOT model, manufactured by Kimray, located in Oklahoma, Okla. having specifications of 12 PG (125PSI) AFN.

Another alternate embodiment from FIG. 1A is to merely delete the line pressure transducer 112.

In any of these embodiments the crucial aspect is the determination of the pressure spike signature. There are many ways in which this can be done, such as peak detection algorithms, simple pressure levels with hysteresis, and peak counting over a time period.

The present invention is capable of offering one or more advantages. For example, a device in accordance with an embodiment of the present invention can be configured to allow multiple wells in a well battery to produce as often as they can. The overall effect is increased production and reduced well loading, and therefore less costly, human intervention.

Figure 2:
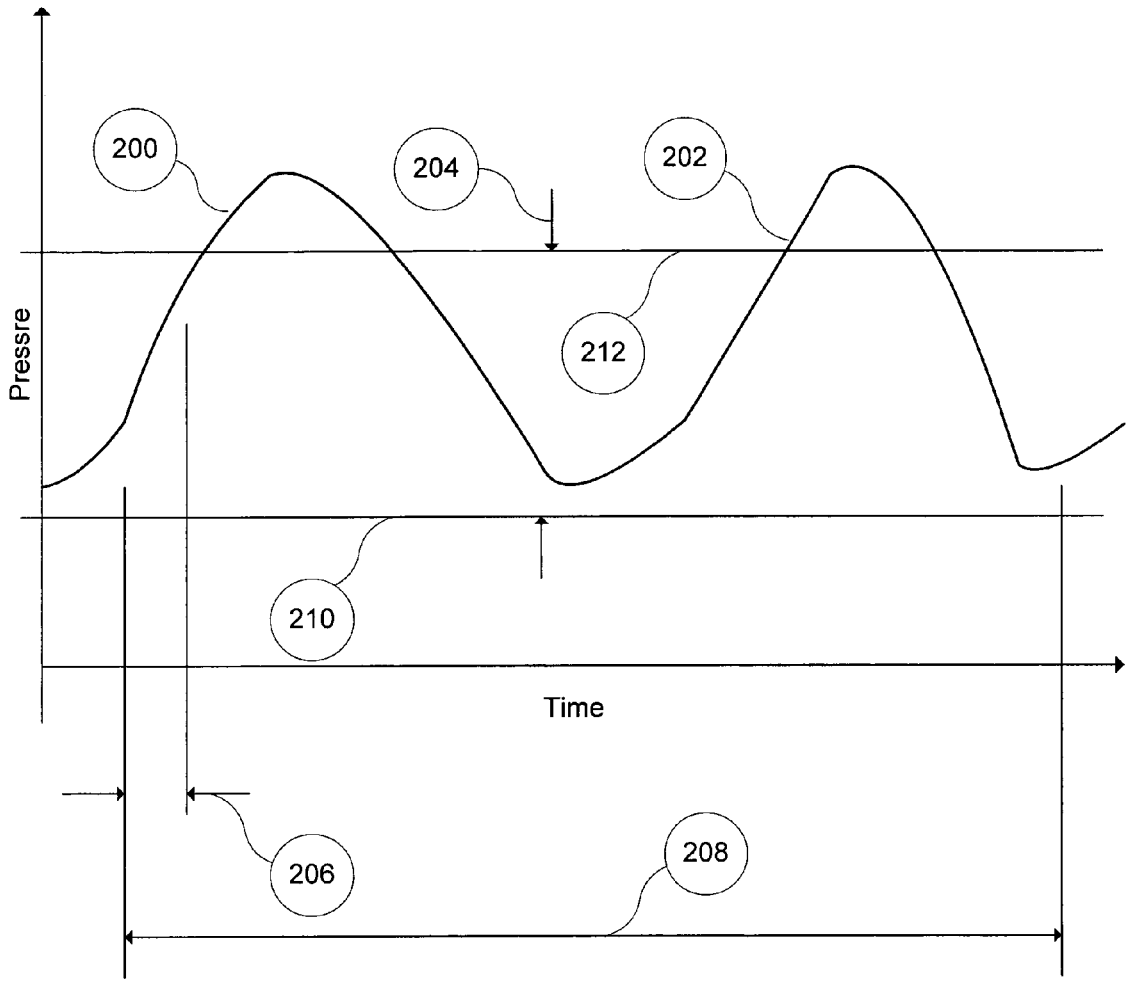
FIG. 2 is a diagram showing a representation of the pressure spike signature that each of the micro controllers in the system will detect.

Referring now to FIG. 2, the line indicated by 200 represents the first increase in pressure or pressure spike in a sales line manifold associated with the opening of a motor valve that is connected to a well head in a well battery. A line indicated by 202 represents the second pressure increase or pressure spike in a sales line manifold associated with the arrival of a plunger in the open well head. Together 200 and 202 make up one form of a pressure signature. A sales line pressure level set point is indicated by the line 212. An average sales line pressure 210 is calculated by the micro controller. A dead band pressure 204 is entered by the user. The sales line pressure level set point 212 is calculated by adding the dead band pressure 204 to the average sales line pressure 210. In an alternate-embodiment, the user can set the sales line pressure level set point 212 on the pressure switch 136, or the user can set the sales line pressure level set point 212 in the micro controller. In all cases this sales line pressure level set point 212 is indeed a set point, and when it is exceeded, it will cause the micro controller to execute encoded instructions to activate a spike delay period 208, because the micro controller now knows that a sister well is producing. The user typically sets the spike delay period 208 to a value greater than the longest period in the well battery for the occurrence of the two pressure spikes 200 and 202 that constitute one example of the pressure signature, thus attempting to ensure that each sister well, in the well battery, can surface their respective plungers. During the spike delay period 208 the controller will not allow the motor valve to be activated. This will in turn prevent the well, which is being monitored by the micro controller, from producing to the sales line manifold, thus allowing the currently active well to successfully complete its flow cycle.

In an alternate embodiment, a time period indicated by 206 is a filter time that can be used to prevent the micro controller from detecting pressure pulses due to normal sales line fluctuations.

Figure 3:
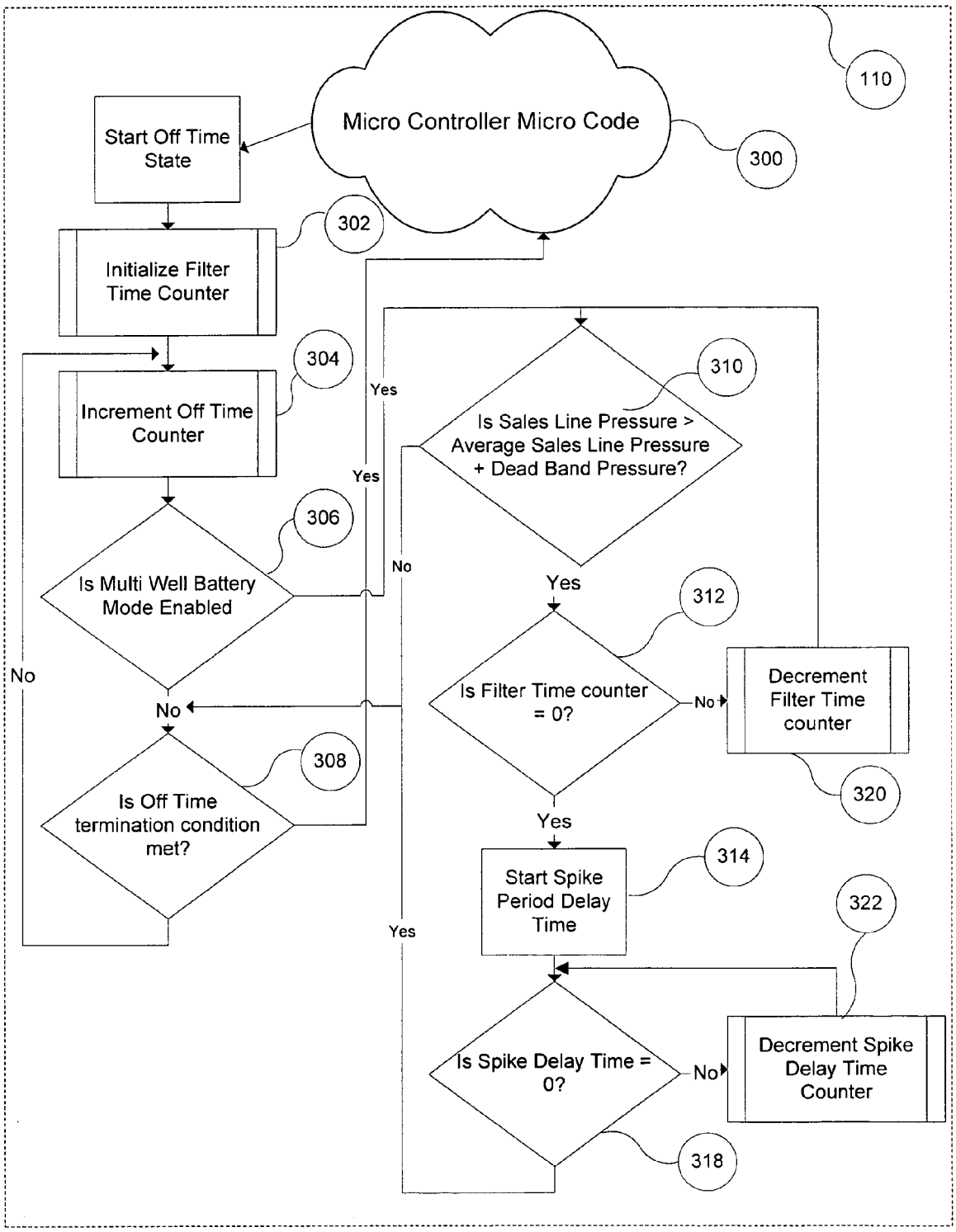
FIG. 3 is a flow diagram illustrating the steps required to implement the method of the present invention within an existing microcontroller.

Referring now to FIG. 3, a state in the operation of a micro code 300 within the micro controller 110 represents a motor valve off time period, commonly understood as the time period that the motor valve is off. The method of the present invention extends the operation of the motor valve off time period to implement the spike delay period 208. The user can optionally select to measure the pressure level using a pressure sensor or a pressure switch to indicate that the sales line pressure level set point 212 has been exceeded.

As with a normal motor valve off time period the motor valve off time counter 304 is decremented and a user selected terminating condition 308 is implemented. The user can select either time or an adjustable differential pressure set point to terminate the motor valve off time period. In the preferred embodiment of this invention a differential pressure set point is used to terminate the motor valve off time period. If the user has selected to implement the multi well battery mode 306 then additional processing begins. The average sales line pressure 210 is constantly updated in background processing. The sales line pressure level set point 212 is checked against the average sales line pressure 210 in step 310, and if the sales line pressure level set point 212 is exceeded by the average sales line pressure 210, the spike delay period 208 is started in step 314, and continues in steps 318 and 322. When the spike delay period 208 terminates, normal processing continues at step 308.

In an alternate embodiment, the optional filter time 206 in steps 312 and 320 is started. When the filter time 206 terminates, then the spike delay period 208 is started in step 314, and continues in steps 318 and 322. When the spike delay period 208 terminates, normal processing continues at step 308. Thus, the user can choose to use the filter time 206 to help prevent false implementation of the spike delay period 208 due to sales line pressure transients.

In addition to the well battery application, the method can be used with any group of wells where the sales line pressure of one well has an effect on another well. In particular, this invention refers to a method of measuring the line pressure in the common manifold or the sales line and detecting a pressure spike or pressure signature to determine if another well is producing when the current well is ready to produce. The pressure in the common manifold or sales line provides a mechanism of communicating the state of wells in the well battery to each of the controllers. If a well in the system is producing, then all other micro controllers on the sister wells will initiate an internal delay timer to allow the producing well to complete its cycle and surface the plunger. The internal timer delay produces a spike delay period. These pressure spikes are related to the action of opening the motor valve from a well in the well battery and the arrival of the plunger in the open well. In effect the system prevents more than one well from producing at any time, but allows wells in the well battery to produce as often as is possible. The method also guarantees there is enough pressure in the well to surface the plunger, thus ensuring that the fluid in the well is removed.

The invention claimed is:

1. In a production system for producing oil or gas from multiple wells, the wells including at least a first well and a second well, each well using an artificial lift system that includes a plunger associated with a motor valve off time, and at least first and second identical connecting subsystems that connect their respective wells to a common sales line, the first connecting subsystem comprising:

a. a plunger arrival sensor connected to a micro controller for sensing the arrival of the plunger in the first well;

b. a wellhead connected to the first well;

c. a motor valve connected to the wellhead, for controlling the production of the first well in response to signals from the micro controller;

d. first and second pressure transducers on either side of the motor valve, conductively coupled to the micro controller, for sensing the differential pressure across the motor valve, and transmitting that differential pressure to the micro controller; and e. the micro controller receptive to signals from the plunger arrival sensor and receptive to signals from the first and second pressure transducers, and having firmware that periodically measures the common sales line pressure to determine an average common sales line pressure, keeps the motor valve closed during the motor valve off time, and extends the motor valve off time following a determination of the existence of a pressure spike in the common sales line due to opening of a motor valve in another of the identical connecting subsystems, wherein the micro controller uses the average of the common sales line pressure plus a user-entered common sales line dead band pressure to calculate a common sales line pressure level set point, which in turn is used to determine if a common sales line pressure spike has occurred.

2. In a production system for producing oil or gas from multiple wells, the wells including at least a first well and a second well, each well using an artificial lift system that includes a plunger associated with a motor valve off time, and at least first and second identical connecting subsystems that connect their respective wells to a common sales line, the first connecting subsystem comprising:

a. a plunger arrival sensor connected to a micro controller for sensing the arrival of the plunger in the first well;

b. a wellhead connected to the first well;

c. a motor valve connected to the wellhead, for controlling the production of the first well in response to signals from the micro controller;

d. a pressure switch on the common sales line side of the motor valve, for sensing the common sales line pressure, and switching its position when the common sales line pressure reaches a certain pressure; and e. the micro controller receptive to signals from the plunger arrival sensor and the pressure switch, and having firmware that periodically monitors the pressure switch to determine an average common sales line pressure, keeps the motor valve closed during the motor valve off time, and extends the motor valve off time following a determination of the existence of a pressure spike in the common sales line due to opening of a motor valve in another of the identical connecting subsystems, wherein the micro controller uses the average of the common sales line pressure plus a user-entered common sales line dead band pressure to calculate a common sales line pressure level set point, which in turn is used to determine if a common sales line pressure spike has occurred.

3. In a production system for producing oil or gas from multiple wells, the wells including at least a first well and a second well, each well using an artificial lift system that includes a plunger associated with a motor valve off time, and at least first and second identical connecting subsystems that connect their respective wells to a common sales line, the first connecting subsystem including a plunger arrival sensor, a wellhead connected to thd first well; a motor valve connected to the wellhead and to the common sales line, and first and second pressure transducers on either side of the motor valve, a method for efficiently producing oil or gas comprising the steps of:

a. sensing the arrival of the plunger in the first well, and transmitting notice of that arrival to a micro controller;

b. sensing the differential pressure across the motor valve, and transmitting that differential pressure to the micro controller; and c. keeping the motor valve closed during the motor valve off time, and extending the motor valve off time following a determination of the existence of a pressure spike in the common sales line due to opening of a motor valve in another of the identical connecting subsystems.

4. The method of claim 3, wherein the micro controller determines if a pressure spike has occurred in the common sales line by comparing the measured pressure in the common sales line with the average of the pressure readings in the common sales line.

5. The method of claim 3, wherein the micro controller determines if a pressure spike has occurred in the common sales line by comparing the measured pressure in the common sales line with a user-entered pressure set point.

6. The method as in claim 4 or 5, wherein the motor valve off time is preset by the user.

7. The method as in claim 4 or 5, wherein the micro controller uses the average of the common sales line pressure plus a user-entered common sales line dead band pressure to calculate a common sales line pressure level set point, which in turn is used to determine if a common sales line pressure spike has occurred.

8. In a production system for producing oil or gas from multiple wells, the wells including at least a first well and a second well, each well using an artificial lift system that includes a plunger associated with a motor valve off time, and at least first and second identical connecting subsystems that connect their respective wells to a common sales line, the first connecting subsystem including a plunger arrival sensor, a wellhead connected to the first well, a motor valve connected to the wellhead and to the common sales line, and a pressure switch on the common sales line side of the motor valve, a method for efficiently producing oil or gas comprising the steps of:

a. sensing the arrival of the plunger in the first well, and transmitting notice of that arrival to a micro controller;

b. monitoring the pressure switch, and transmitting notice of the tripping of the pressure switch to the micro controller; and c. keeping the motor valve closed during the motor valve off time, and extending the motor valve off time following a determination of the existence of a pressure spike in the common sales line due to opening of a motor valve in another of the identical connecting subsystems.

9. The method of claim 8, wherein the user presets both the pressure switch and the motor valve off time.

10. The method as in claim 8 or 9, wherein the micro controller uses the average of the common sales line pressure plus a user-entered common sales line dead band pressure to calculate a common sales line pressure level set point, which in turn is used to determine if a common sales line pressure spike has occurred.

11. In a production system for producing oil or gas from multiple wells, the wells including at least a first well and a second well, each well using an artificial lift system that includes a plunger associated with a motor valve off time, and at least first and second identical connecting subsystems that connect their respective wells to a common sales line, the first connecting subsystem comprising:

a. a plunger arrival sensor connected to a micro controller for sensing the arrival of the plunger in the first well;

b. a wellhead connected to the first well;

c. a motor valve connected to the wellhead, for controlling the production of the first well in response to signals from the micro controller;

d. a pressure transducer on the common sales line side of the motor valve, for sensing the common sales line pressure, and transmitting that pressure to the micro controller; and e. the micro controller receptive to signals from the plunger arrival sensor and the pressure transducer, and having firmware that periodically monitors the pressure transducer to determine an average common sales line pressure, keeps the motor valve closed during the motor valve off time, and extends the motor valve off time following a determination of the existence of a pressure spike in the common sales line due to opening of a motor valve in another of the identical connecting subsystems, wherein the micro controller uses the average of the common sales line pressure plus a user-entered common sales line dead band pressure to calculate a common sales line pressure level set point, which in turn is used to determine if a common sales line pressure spike has occurred.

12. In a production system for producing oil or gas from multiple wells, the wells including at least a first well and a second well, each well using an artificial lift system that includes a plunger associated with a motor valve off time, and at least first and second identical connecting subsystems that connect their respective wells to a common sales line, the first connecting subsystem including a plunger arrival sensor, a wellhead connected to the first well, a motor valve connected to the wellhead and to the common sales line, and a pressure transducer on the common sales line side of the motor valve, a method for efficiently producing oil or gas comprising the steps of:

a. sensing the arrival of the plunger in the first well, and transmitting notice of that arrival to a micro controller;

b. monitoring the pressure transducer, and transmitting the sales line pressure to the micro controller; and c. keeping the motor valve closed during the motor valve off time, and extending the motor valve off time following a determination of the existence of a pressure spike in the common sales line due to opening of a motor valve in another of the identical connecting subsystems.

13. The method of claim 12, wherein the user presets the motor valve off time.

14. The method as in claim 12 or 13, wherein the micro controller uses the average of the common sales line pressure plus a user-entered common sales line dead band pressure to calculate a common sales line pressure level set point, which in turn is used to determine if a common sales line pressure spike has occurred.

* * * * *